United States Patent [19]

Katona

[11] 4,253,286

[45] Mar. 3, 1981

[54] CLIP-AIRE OVEN DOOR WINDOW

[76] Inventor: Joseph W. Katona, 2222 Paulette Dr., Walled Lake, Mich. 48088

[21] Appl. No.: 954,977

[22] Filed: Oct. 26, 1978

[51] Int. Cl.[3] ..... E06B 7/12

[52] U.S. Cl. ..... 52/171; 52/790; 126/198; 126/200

[58] Field of Search ..... 52/790, 788, 773, 775, 52/171, 487, 202, 203; 126/198, 200

[56] References Cited

U.S. PATENT DOCUMENTS

| | | | |
|---|---|---|---|
| 2,060,579 | 11/1936 | Krantz | 52/171 |
| 2,325,773 | 4/1943 | Hennessy | 52/788 |
| 3,855,994 | 12/1974 | Evans | 52/788 |
| 3,996,710 | 12/1976 | Nuss | 52/202 |
| 4,023,554 | 5/1977 | Katona | 126/200 |
| 4,041,930 | 8/1977 | Katona | 126/200 |
| 4,043,091 | 8/1977 | Katona | 52/788 |

FOREIGN PATENT DOCUMENTS

| | | | |
|---|---|---|---|
| 1052661 | 3/1959 | Fed. Rep. of Germany | 52/775 |
| 6405335 | 5/1964 | Netherlands | 52/487 |

*Primary Examiner*—Price C. Faw, Jr.
*Assistant Examiner*—Henry E. Raduazo
*Attorney, Agent, or Firm*—Whittemore, Hulbert & Belknap

[57] ABSTRACT

A self-contained window unit adapted to be assembled in an oven door. The window unit comprises at least two glass panes held in spaced parallel relation by a channel-shaped spacer having means engaging the peripheral edge portion of one of the panes, and individual clips or brackets mounted on the spacer and having clip portions engaging the peripheral edge portion of the other pane. The clips may be designed to hold third and fourth glass panes in spaced parallel relation to the first two panes.

10 Claims, 8 Drawing Figures

CLIP-AIRE OVEN DOOR WINDOW

SUMMARY OF THE INVENTION

This invention relates to a self-contained window unit having at least two glass panes held in spaced parallel relation to one another.

In accordance with the specific constructions about to be described, the self-contained window unit is adapted to be assembled into an oven door having front and back door panels formed with aligned window openings. The glass panes are held in spaced parallel relation by a substantially continuous channel-shaped spacer and a plurality of clips or brackets. One of the panes is held by the spacer. The clips are mounted on the spacer and have clip portions for engaging and supporting a second pane. The spaces between the clips allow upward flow of air through the door and window unit. The window unit may include third and fourth window panes and the clips formed to support them in spaced parallel relation to the first two panes.

The use of spaced mounting clips for supporting one or more panes of the window unit minimizes thermal conduction and provides for maximum air flow in the spaces between the clips communicating with the air passage in the door.

The clips do not need to be welded or otherwise secured to the spacer nor do they need to be made of a high grade spring steel material. They are designed to be easily assembled with the spacer and are locked into position by one of the glass panes when it is assembled into the unit. The clips preferably have a locating flange for positioning the window unit with respect to the window opening in the door.

Only a minimum number of operations are required to produce and assemble the parts of the window unit. The unit is also easy to assemble and when assembled the parts thereof will not accidentally become separated.

Other objects and features of the invention will become more apparent as this description proceeds, especially when taken in conjunction with the accompanying drawings wherein.

Figure 2:
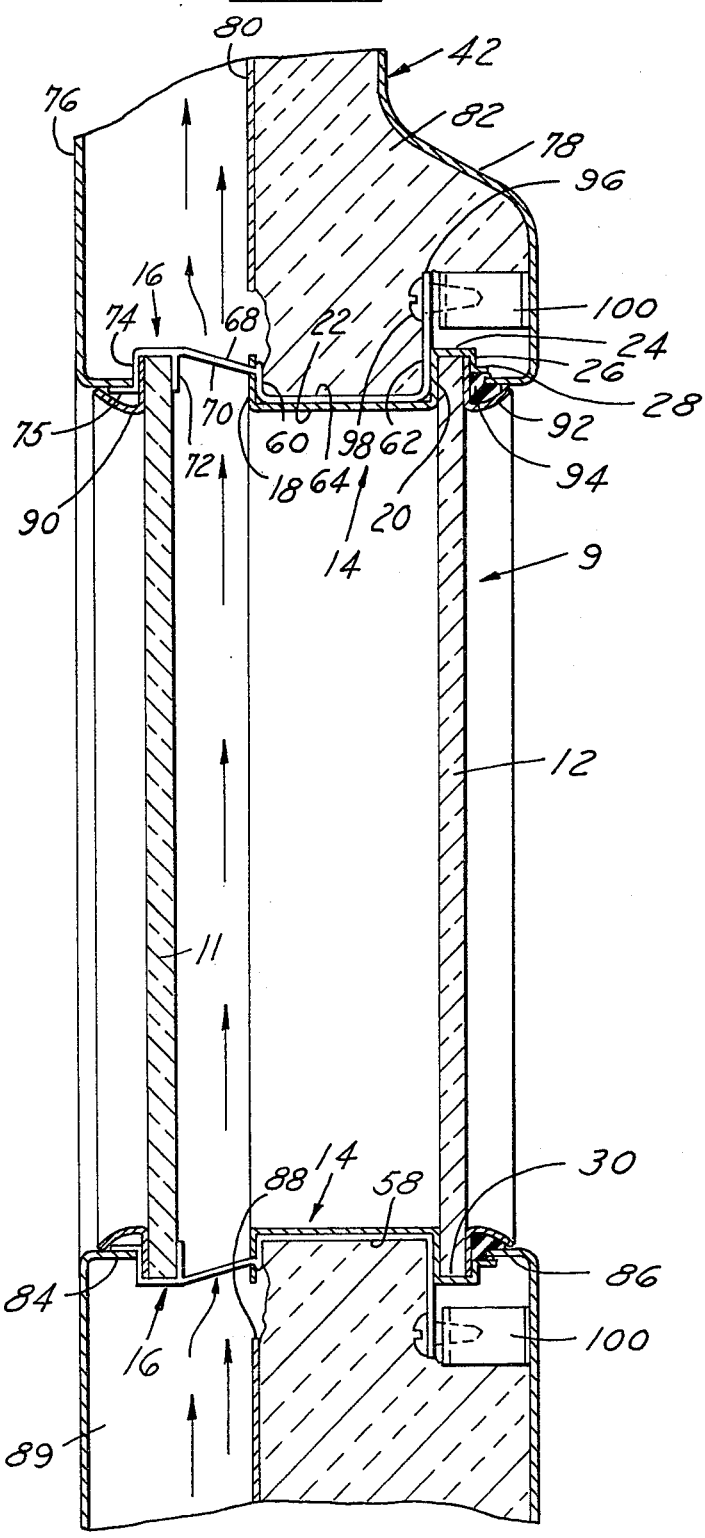
FIG. 2 is a vertical sectional view of the window unit shown in FIG. 1.
Figure 4:
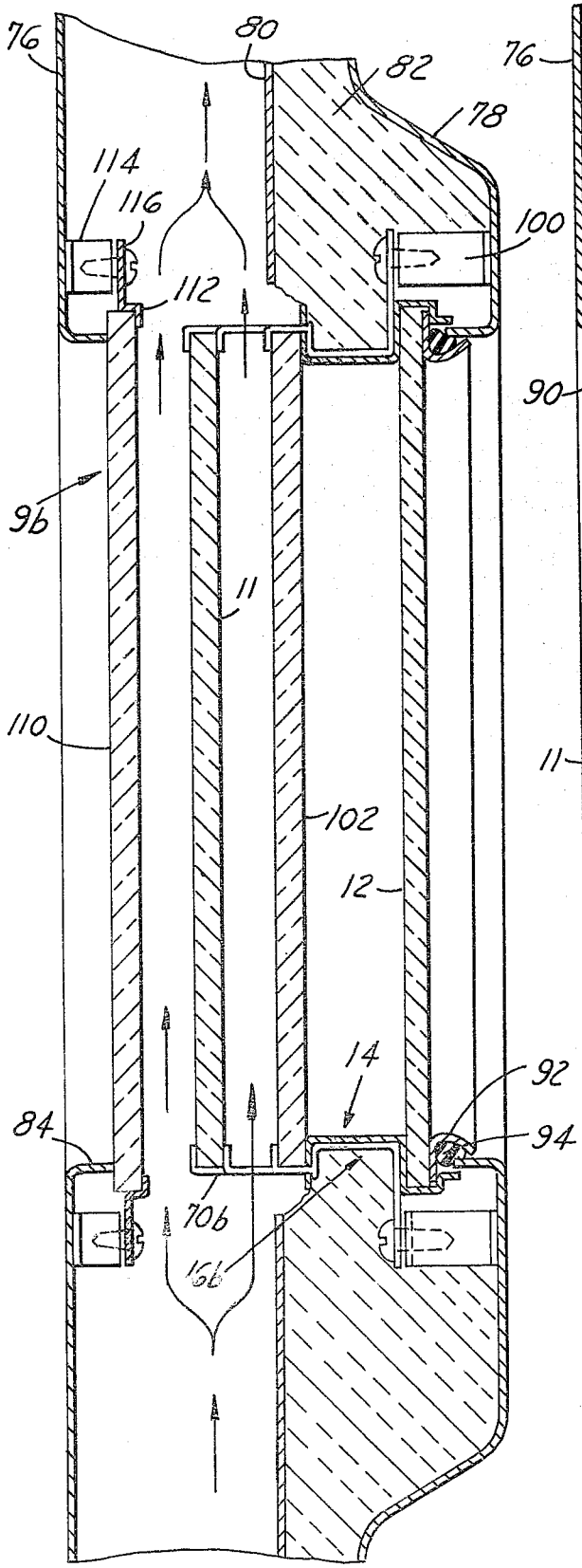

FIG. 4 also is similar to FIG. 2 and shows a further modification.

Figure 5:
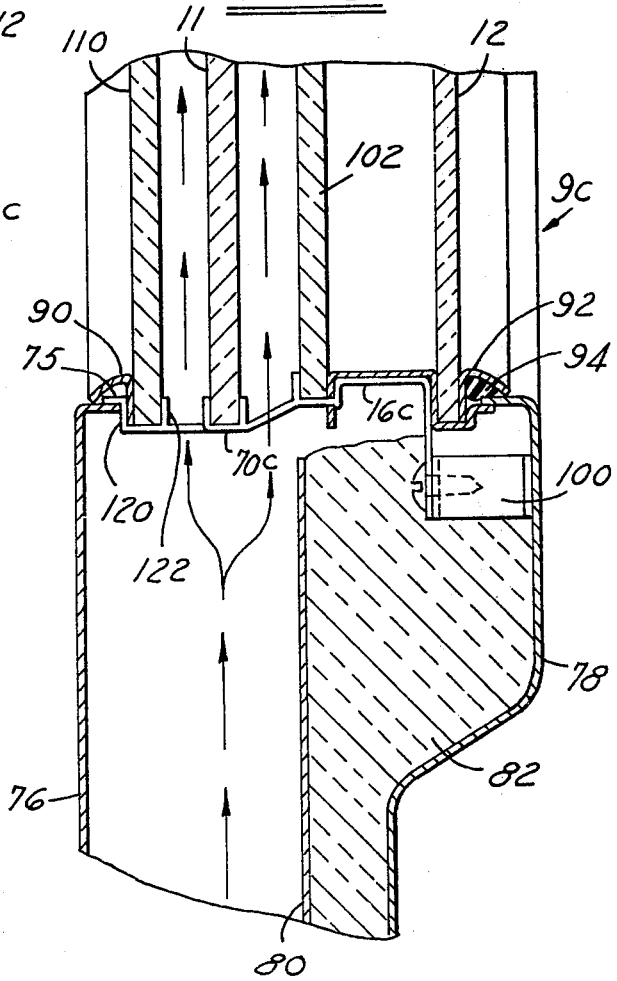

FIG. 5 is similar to a portion of FIG. 2 and shows still another modification.

Figure 3:
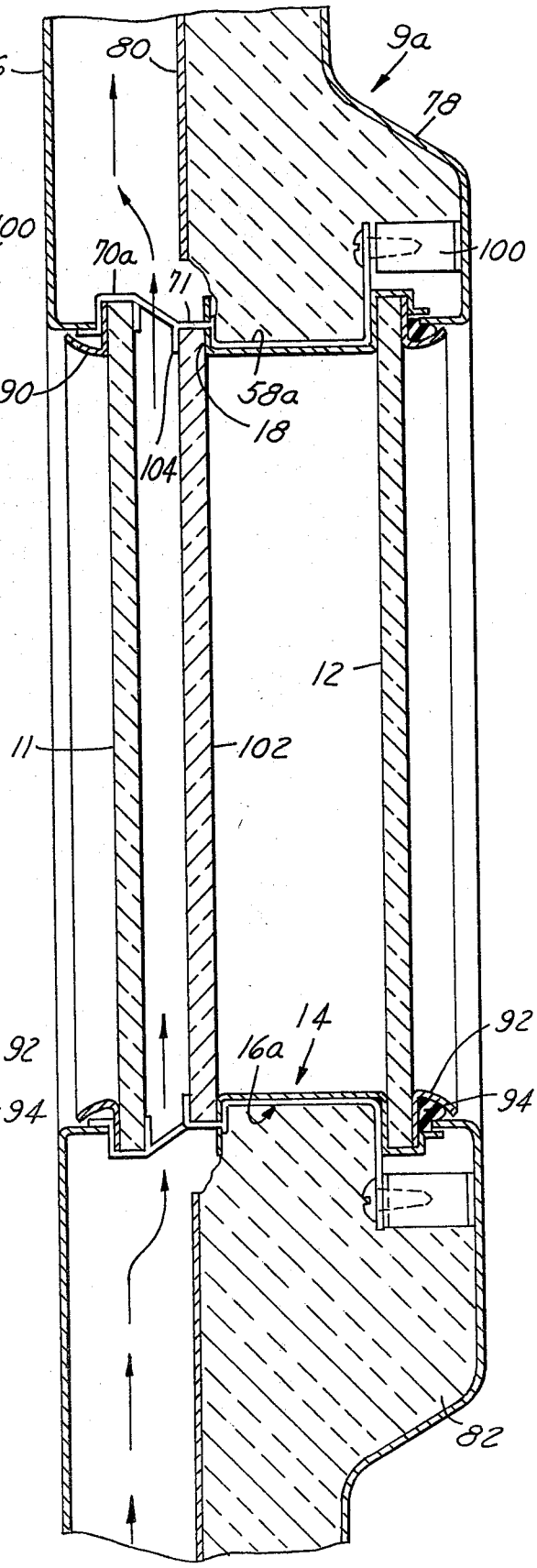
FIG. 3 is a view similar to FIG. 2 showing a modification of the invention.
Figure 6:
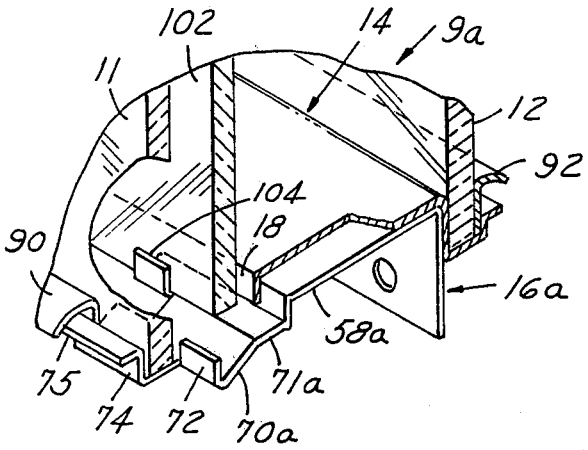

FIG. 6 is a fragmentary perspective view in section showing a portion of the structure in FIG. 3.

Figure 7:
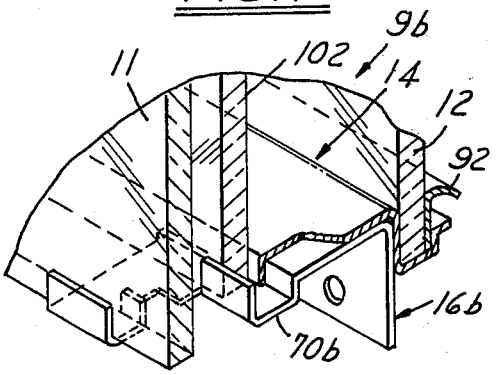

FIG. 7 is a fragmentary perspective view in section showing a portion of the structure in FIG. 4.

Figure 8:
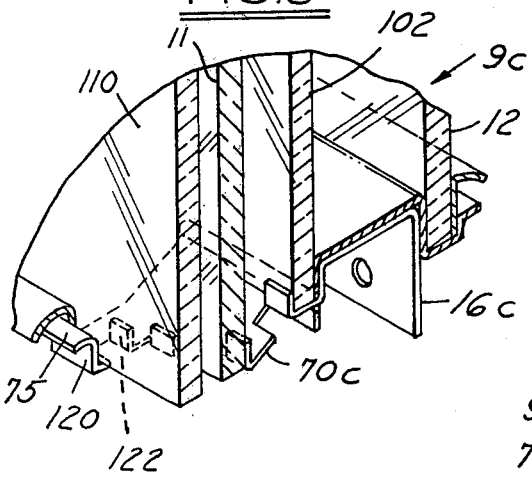

FIG. 8 is a fragmentary perspective view in section showing a portion of the structure in FIG. 5.

Figure 1:
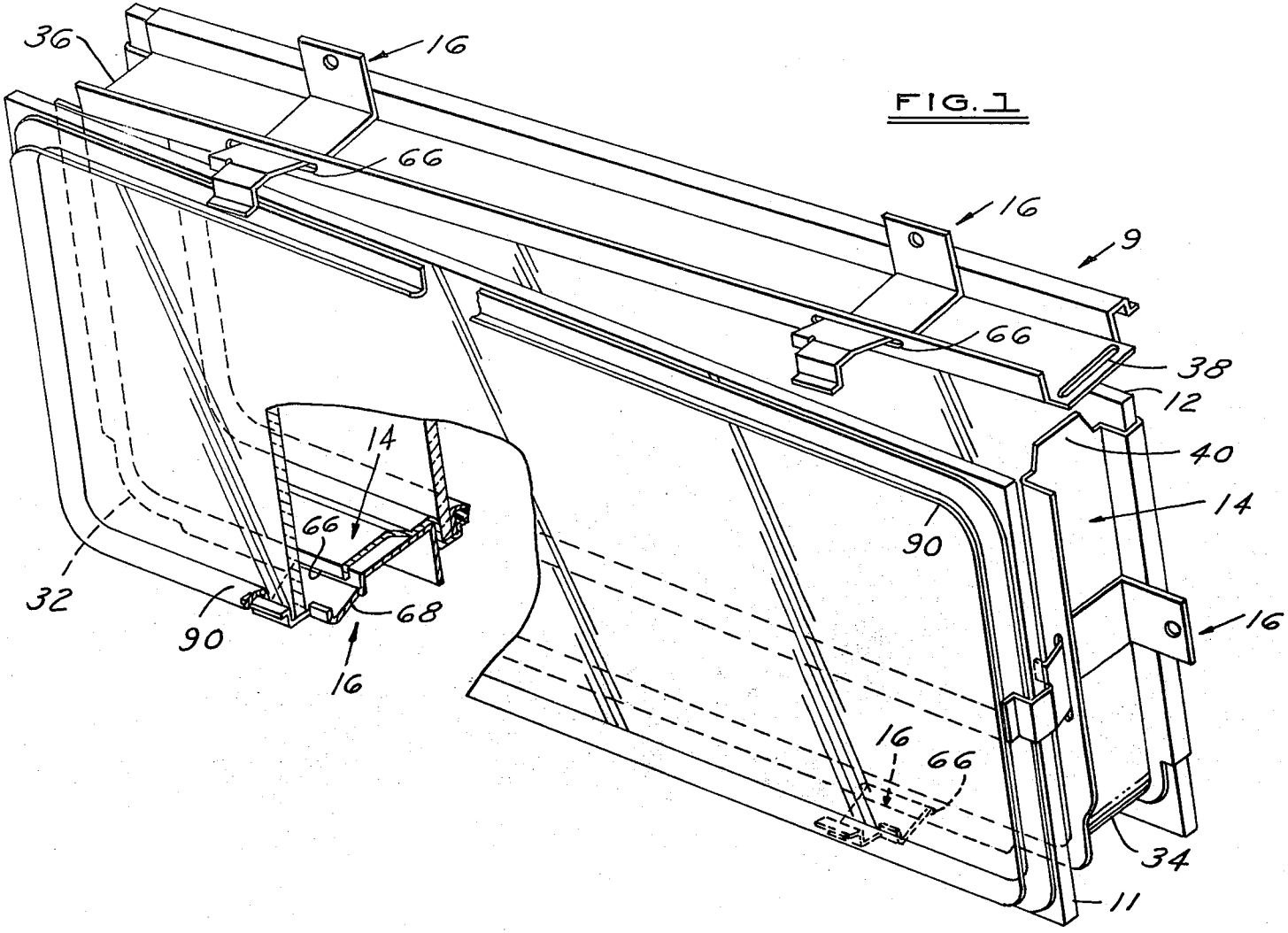
FIG. 1 is a perspective view with parts broken away and in section showing a partially assembled window unit of my invention.

Referring now more particularly to the drawings and especially to FIGS. 1 and 2, the self-contained window unit 9 has a pair of rectangular glass panes 11 and 12 secured together and retained in spaced parallel relation by a substantially continuous rectangular spacer 14 and a plurality of clips or brackets 16. The pane 12 which is at the oven side when the window unit is mounted in the door, may be formed for example from tempered, coated or other heat resistant glass. The pane 11, which is at the kitchen side, may be formed for example of raw, tempered or coated glass.

The spacer 14 is roll formed to the configuration shown from an elongated piece of flat stock, preferably metal. The spacer 14 has a main portion which is channel-shaped in cross section having spaced parallel side walls 18 and 20 extending outwardly from the opposite edges of the web 22. The outwardly extending side wall 20 is bent rearwardly to provide the wall 24 which is parallel to web 22. A wall or flange 26 extends inwardly from the wall 24 in spaced parallel relation to the side wall 20 and terminates in an angled pilot flange 28. The walls 20, 24 and 26 provide a glass-receiving channel 30 for the glass pane 12.

The elongated member from which the spacer 14 is made is pre-notched in the flat, that is before it is roll formed, at three points corresponding to three corners of the rectangular spacer so that it may be hand bent to such rectangular configuration. At the two corners 32 and 34, the notching extends inwardly from both side edges to about half the height of the channel side walls 18 and 20 which is sufficient to permit radius bending as indicated. At the third corner 36 where the bend is a sharp crease or fold, the notching extends inwardly from both side edges up to but not including the web 22, in order to permit the web 22 to be folded as shown. The corner fold 36 permits the top wall of the spacer to be swung up approximately 90° to permit installation of the two glass panes as will be more clearly explained in the following description and then to be swung down to the position of use to close the spacer in its intended rectangular configuration. The corners 32 and 34 may also be of the folded or creased type shown at 36, if desired.

One end of the spacer 14 is provided with a slot 38 in the web 22. The other end is formed with a tab 40 which extends from the web and is adapted to project through the slot 38 after which it may be bent over to retain the spacer in its rectangular form supporting the two glass panes in spaced parallel relation. The slot 38 and tab 40 may be formed at the same time that the spacer is pre-notched.

The clips or brackets 16 are mounted on the spacer and support the pane 11. At least one such clip is provided along each of the top and bottom walls of the spacer. In the present instance, two are shown at the top and two at the bottom. FIG. 1 shows a single clip along one side wall of the spacer although obviously more than one may be provided. A similar clip or clips, not shown, is also provided along the remaining side wall of the spacer.

Each clip comprises a channel-shaped mounting portion 58 having side walls 60 and 62 extending outwardly from a web 64. When the clips are assembled with the spacer, as shown in FIG. 2, the mounting portion 58 seats within the spacer with the web 64 of the mounting portion engaging the web 22 of the spacer and with the side walls 60 and 62 of the mounting portion, which are spaced apart only slightly less than the side walls 18 and 20 of the spacer, in light friction contact with the side walls of the spacer.

At each clip location, the side wall 18 of the spacer has an elongated slot 66 through which the clip portion 68 of the clip extends. Each slot is of a size to permit the clip, before pane 11 is installed, to turn or rock relative to the spacer about the longitudinal edges of the slot as a fulcrum. The clip portion extends forwardly from the side wall 60 just below the upper edge thereof and has a plate part 70. Projecting laterally inwardly from the plate part 70 is a flange 72 which extends over the rear peripheral surface of the pane 11 and a flange 74 which extends over the front peripheral surface thereof. These flanges 72 and 74 form with the plate part what is in effect a channel for receiving the edge portion of the glass pane 11. The flange 74 terminates in a forwardly extending pilot flange 75.

FIG. 2 illustrates the window unit 9 installed in an oven door 42 which includes a front door panel 76, a rear door panel 78, and a centrally disposed baffle 80. The baffle 80 is adapted to retain insulating material 82 between the baffle and the rear panel 78. The front door panel 76 has a rectangular rearwardly turned flange 84 and the rear panel 78 has a rectangular forwardly turned flange 86. The apertures defined by the flanges 84 and 86 of the door panels are aligned and constitute the window opening of the oven door. When the window unit is installed in the door, the pilot flange 28 on the spacer fits over the rear door flange 86 and the pilot flanges 75 of the clips fit inside the front door flange 84. The baffle 80 has a rectangular aperture 88 aligned with the window opening in the door but somewhat larger in dimension. An air passage 89 is defined between the baffle 80 and the front door panel 76.

An annular trim ring or molding 90 extends about the front peripheral surface of the pane 11. This trim ring is generally J-shaped in cross section and has one leg which extends between and contacts the outer surface of the pane 11 and the flange 74 of each mounting clip. An annular trim ring or molding 92 likewise generally J-shaped in cross section extends around the outer peripheral surface of the rear glass pane 12. This molding 92 has a leg which extends between and contacts the outer peripheral surface of pane 12 and the flange 26 of the spacer 14. An elongated asbestos cord 94 extends within the molding 92 and seals against the edge of the flange 86 of the rear door panel when the window unit is installed in the door. Instead of asbestos, the cord may be of fiber glass or in the form of a silicon extrusion.

Each mounting clip has an extension 96 on its side wall 62 for the purpose of mounting the window unit within the window opening of the oven door. FIG. 2 shows the window unit installed in the oven door with the extensions 96 of the clips secured by fasteners 98 to brackets 100 welded or otherwise secured to the rear door panel 46.

In order to assemble the window unit 9, the clips 16 are joined to the spacer 14 by inserting the mounting portions 58 thereof through the slots 66 in a rearward direction or towards the right in FIG. 2, and then turning the clips about the slot edges as a fulcrum to seat the mounting portions of the clips in the channel of the spacer in the manner shown. The clips will remain seated in the spacer in light friction contact. When all of the clips are installed on the spacer, the top wall of the spacer is unfolded 90° to extend vertically upwardly, after which the two glass panes are inserted from above. The pane 12 is inserted into the glass-receiving channel 30 of the spacer and the pane 11 is inserted in the channel formed by the flanges 72 and 74 of the side and bottom clips. Thereafter, the top wall of the spacer is folded down and the tab 40 projected through the slot 38 and bent over to hold the rectangular form of the spacer. The window unit is now complete with all four sides of the pane 12 peripherally engaged in the channel 30 of the spacer and all four sides of the pane 11 peripherally engaged in the channels formed by the clip flanges 72 and 74. The trim rings 90 and 92 and sealing cord 94 may be applied to the window unit before the window unit is installed in the door. The clips are retained by the pane 11 firmly seated in the channel of the spacer and cannot become accidentally dislodged.

The front wall 76 of the oven door may be removed or swung open to permit installation of the window unit. The clips are connected to brackets 100 on the rear door panel 46 by fasteners 98 to secure the window unit in place.

As seen in FIG. 2, cooling air passing upward through the air passage 89 in the door flows through the space behind the front pane 11 without any appreciable interference from the clips 16, thereby cooling the inner surface of the front pane 11 to reduce the temperature of its outer surface. The clips are of relatively small width so that there are large open spaces between the clips for the free flow of air. Thus there is provided a self-contained window unit that permits a maximum air flow for cooling and a minimum of thermal conduction.

FIGS. 3–8 show modifications which are generally like FIGS. 1 and 2 but differ in the particulars noted.

FIGS. 3 and 6 show a modified window unit **9*a* having an intermediate or third pane 102 in addition to the front and rear panes 11 and 12. The clips 16*a* are substantially like the clips 16 although the plate part 70*a* has a flattened area 71*a* near the mounting portion 58*a* from which projects laterally inwardly a flange 104 which cooperates with the adjacent side wall 18 of the spacer to form a channel for receiving the peripheral edge portion of the third pane 102. The airflow through the window unit is in the space between the first pane 11 and the third or intermediate pane 102. In this construction, the space between the two panes 12 and 102 is mechanically sealed by the spacer 14, providing a dead air space and thereby maintaining a somewhat cooler front panel than would be possible in the two-pane window unit of FIGS. 1 and 2**.

FIGS. 4 and 7 show a further modification in which the clips **16*b* of window unit 9*b* are substantially like the clips 16*a* in FIG. 3 except the plate part 70*b* of the clip portions are substantially straight or flat. In this construction, the pane 11 held by the clips is completely disengaged from the front panel of the door. A fourth pane 110 separates from the window unit 9*b* is mounted on the front door panel. The pane 110 is clamped against the flange 84 of the front door panel along its four sides adjacent the periphery thereof by clips 112 secured to brackets 114 by screws 116. The brackets 114** are secured to the front panel by any suitable means such as by welding.

FIGS. 5 and 8 show a further modification in which the fourth glass pane 110 is supported by and forms a part of the window unit **9*c*. The clips 16*c* are generally similar to the clips 16*a* in FIG. 3 except that the plate part 70*c* of the clip portion of each clip has a further forward extension provided with inwardly directed and laterally spaced flanges 120 and 122 which form a channel for receiving the peripheral edge portion of the fourth pane. In this case, the pilot flange 75 which engages within the front door panel flange 84 is formed as a terminal extension of the flange 120**.

The four-pane constructions shown in FIGS. 4 and 7 and FIGS. 5 and 8 are designed particularly for ovens equipped for pyrolytic self-cleaning. These installations provide a dual air wash by the flow of air over the inner surface of the outermost pane 110 and over both sides of the pane 11.

What I claim as my invention is:

1. A self-contained window unit adapted to be assembled in an oven door having front and back panels with aligned window openings therein, comprising first and second glass panes, means for holding said panes in spaced parallel relation including a substantially continuous spacer between said panes having means engaging the peripheral edge portion of one of said panes and having outwardly opening channel-shaped seat portions, and individual clips having mounting portions of outwardly opening channel-shaped configuration matching that of said seat portions and seated in said seat portions, said clips being fulcrummed on said spacer in a manner permitting movement of said mounting portions thereof into and out of seating engagement in said seat portions, said clips also having clip portions spaced from the fulcrum point thereof and engaging the peripheral edge portion of the other of said panes to support said other pane and to retain said mounting portions of said clips seated in said seat portions.

2. A self-contained window unit adapted to be assembled in an oven door having front and back panels with aligned window openings therein and means defining an air passage to allow air to flow upwardly through the door, comprising first said second glass panes, means for holding said panes in spaced parallel relation including a substantially continuous outwardly opening channel-shaped spacer between said panes having means engaging the peripheral edge portion of one of said panes, said spacer having peripherally spaced slots, and individual clips having mounting portions, said mounting portions each having an outwardly opening channel-shaped configuration matching that of said spacer and seated in said spacer, said clips projecting through said respective slots and being fulcrummed in said slots in a manner permitting movement of said mounting portions into and out of seating engagement in said spacer, said clips also having clip portions at the side of said slots opposite the mounting portions thereof engaging the peripheral edge portion of the other of said panes to support said other pane and retain said mounting portions of said clips seated in said spacer, said clips being spaced to define openings communicating with the air passage in the door to allow air to flow upwardly between said panes.

3. A self-contained window unit as defined in claim 1 or 2, wherein said clips have portions for securing the same to one of said door panels.

4. A self-contained window unit as defined in claim 1 or 2, wherein said clips have locating flanges for locating said window unit with respect to the window opening in one of said panels.

5. A self-contained window unit as defined in claim 2, wherein said clips are assembled with said spacer by passing the mounting portions thereof through said slots and rocking said clips with respect to said slots to seat said mounting portions in said spacer.

6. A self-contained window unit as defined in claim 1 or 2 or 5, wherein said spacer and clips have locating flanges for locating said window unit with respect to the window openings in both said panels.

7. A self-contained window unit as defined in claim 5, wherein said clips have portions for securing the same to one of said door panels.

8. A self-contained window unit adapted to be assembled in an oven door having front and back panels with aligned window openings therein and means defining an air passage to allow air to flow upwardly through the door, comprising first and second glass panes, means for holding said panes in spaced parallel relation including a substantially continuous outwardly opening channel-shaped spacer between said panes having means engaging the peripheral edge portion of one of said panes, said spacer having peripherally spaced slots, and individual clips having mounting portions seated in said spacer, said mounting portions each having a channel-shaped configuration matching that of said spacer, said clips having clip portions projecting through said respective slots and engaging the peripheral edge portion of the other of said panes to support said other pane and retain said mounting portions of said clips seated in said spacer, said clips being spaced to define openings communicating with the air passage in the door to allow air to flow upwardly between the panes, said clips being assembled with said spacer by passing the mounting portions thereof through said slots and rocking said clips with respect to said slots to seat said mounting portions in said spacer, and a third glass pane held by said clip portions in spaced relation to said first and second panes.

9. A self-contained window unit as defined in claim 8, including a fourth glass pane held by said clip portions in spaced parallel relation to said first, second and third panes.

10. A self-contained window unit as defined in claim 8, including a fourth glass pane free of said clips and attached to the front wall of said door.

* * * * *